US007315720B2

(12) United States Patent
Kondo

(10) Patent No.: US 7,315,720 B2
(45) Date of Patent: Jan. 1, 2008

(54) IMAGE FORMING APPARATUS

(75) Inventor: Takashi Kondo, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/041,311

(22) Filed: Jan. 25, 2005

(65) Prior Publication Data

US 2005/0220504 A1 Oct. 6, 2005

(30) Foreign Application Priority Data

Apr. 6, 2004 (JP) ..... 2004-112096

(51) Int. Cl.
*G03G 15/01* (2006.01)
*G03G 15/16* (2006.01)

(52) U.S. Cl. ..... 399/301; 399/66

(58) Field of Classification Search ..... 399/301
See application file for complete search history.

(56) References Cited

U.S. PATENT DOCUMENTS

| | | | | |
|---|---|---|---|---|
| 5,818,506 | A * | 10/1998 | Yamaguchi et al. | 347/259 |
| 5,940,114 | A * | 8/1999 | Kataoka et al. | 347/248 |
| 6,049,350 | A | 4/2000 | Yamaguchi | 347/241 |
| 6,832,060 | B2 * | 12/2004 | Tanaka et al. | 399/66 |
| 2006/0153603 | A1 * | 7/2006 | Nishikawa et al. | 399/301 |

FOREIGN PATENT DOCUMENTS

| | | |
|---|---|---|
| JP | 07-168414 | 7/1995 |
| JP | 10-104909 | 4/1998 |
| JP | 2001-125027 | 5/2001 |
| KR | 2001-0021019 | 3/2001 |
| KR | 10-2001-0062403 A | 7/2001 |
| KR | 2004-0021529 | 3/2004 |

* cited by examiner

*Primary Examiner*—Andrew H. Hirshfeld
*Assistant Examiner*—Jeff Natalini
(74) *Attorney, Agent, or Firm*—Roylance, Abrams, Berdo & Goodman LLP

(57) ABSTRACT

An image forming apparatus that senses image position differences without a dedicated light source or driver circuit, the apparatus including a transfer belt and an image forming unit for deflecting a light emitted from a light source, forming a latent image on a surface by scanning the deflected light, developing the latent image, and transferring the developed image onto the belt or recording medium delivered by the belt. The apparatus also includes an optical path changing unit for changing an optical path of the light before it reaches the deflecting unit and guiding the light to a sensing position of a sensing image formed on the surface of the transfer belt, a sensing unit for receiving a light reflected or transmitted by the sensing position and sensing the sensing image, and a control unit for controlling the image forming unit according to the sensing signal sensed by the sensing unit.

13 Claims, 4 Drawing Sheets

IMAGE FORMING APPARATUS

CROSS-REFERENCE TO RELATED APPLICATIONS

This application claims the benefit under 35 U.S.C. §119 (a) of Japanese Patent Application No. 2004-112096, filed in the Japanese Intellectual Property Office on Apr. 6, 2004, the entire disclosure of which is incorporated herein by reference.

BACKGROUND OF THE INVENTION

1. Field of the Invention

The present invention relates to an image forming apparatus. More particularly, the present invention relates to a tandem-type image forming apparatus.

2. Description of the Related Art

A tandem-type image forming apparatus includes a delivering belt for delivering a recording medium, a laser scanning unit (LSU) for scanning using a laser beam, a photosensitive drum, and a fixing unit. The photosensitive drum receives the laser beam to form a latent image, attaches and develops a toner to form a toner image, and transfers the toner image onto the transfer paper. The fixing unit then fixes the image formed onto the transfer paper. In such an image forming apparatus, a plurality of laser scanning units and a plurality of photosensitive drums are installed to develop an image using toners of different primary colors (such as cyan, magenta, yellow, and black). Color images are then formed by transferring and overlapping the different color images onto the transfer paper.

However, when the color image is formed using the conventional image forming apparatus, if the overlapping of the different color images is even slightly mismatched, an image characteristic is degraded. Therefore, an image forming apparatus having an adjusting unit for sensing and compensating for the mismatching of the image has been proposed. In the adjusting unit, toner patches consisting of respective colors are disposed on both edges of the delivering belt, and an optical sensor unit senses a position difference (that is, a color difference) of the toner patches. A correction amount such as a read timing or a magnification correction is calculated based on the color difference data, and thereby, the LSU or the photosensitive drum can be corrected.

The optical sensor unit for sensing the color difference of the toner patches includes a light source such as a light emitting diode (LED) or a semiconductor laser, a light receiving sensor for receiving a reflected or transmitted light and sensing a color difference of the toner patches, an optical lens and a driver circuit, as noted in Japanese Patent Nos. 63-300261 and 7-261628, the entire disclosures of which are incorporated herein by reference.

An image forming apparatus having an optical path changing unit has also been proposed. The optical path changing unit changes an optical path of a laser beam scanned from an LSU and guides the laser beam to a sensing position of the toner patch. A moving mirror is disposed on the optical path of the laser beam. When sensing the color difference of the toner patches, the optical path changing unit reflects the laser beam, which is emitted from the LSU, and guides it toward the sensing position using a fixed mirror as noted in Japanese Patent No. 2002-23450, the entire disclosure of which is incorporated herein by reference.

However, the first conventional image forming apparatus requires a number of expensive devices, such as the light source, the light receiving sensor, the optical lens and the driver circuit, resulting in an increased cost. Also, there is a limit to the optical lens when narrowing the laser beam of the LED. Since the LED has a short focal distance, it is susceptible to the distortion of the delivering belt. Therefore, if the LED is used as the light source, the sensing precision is degraded.

Further, in the second conventional image forming apparatus, the scan speed of the scanning laser beam is very fast as compared with the motion speed of the delivering belt. Therefore, the laser beam is only momentarily scanned on the sensing position, such that the sensing precision is degraded.

Accordingly, a need exists for a lower cost system and method for sensing a position difference to provide a quality image.

SUMMARY OF THE INVENTION

The present invention substantially resolves the above and other problems and provides an image forming apparatus having a reduced cost and which is capable of precisely sensing a position difference.

According to an aspect of the present invention, an image forming apparatus is provided including a transfer belt, and an image forming unit for deflecting a light emitted from a light source using a deflecting unit, forming a latent image on a surface of a charged photosensitive unit by scanning the deflected light, developing the latent image, and transferring the developed image onto the transfer belt or a recording medium delivered by the transfer belt. The image forming apparatus further includes an optical path changing unit for changing an optical path of the light emitted from the light source before the light reaches the deflecting unit and guiding the light to a sensing position of a sensing image formed on the surface of the transfer belt, a sensing unit for receiving a light reflected or transmitted by the sensing position and sensing the sensing image, and a control unit for controlling the image forming unit according to the sensing signal sensed by the sensing unit.

According to the present invention, a dedicated light source or driver circuit is not required to sense the position difference. The sensing laser beam is scanned to the sensing positions using the light source of the image forming unit. Further, while the optical path is changed by the optical path changing unit, the sensing laser beam is not scanned but illuminates the sensing positions.

The image forming apparatus may further include an optical path branching unit for branching the optical path of the light emitted from the light source into several paths toward a plurality of sensing images formed on a surface of the transfer belt. The optical path changing unit guides the branched lights to the sensing positions of the sensing images.

Therefore, a position difference of an image can be sensed at a plurality of sensing positions.

The image forming unit may further include an imaging element for imaging the deflected light onto a scanning line, and imaging the light whose optical path is changed by the optical path changing unit onto the sensing positions.

Therefore, it is unnecessary to install a dedicated imaging element to sense the position difference, since the light illuminating the sensing positions can be narrowed by the imaging element of the image forming unit.

BRIEF DESCRIPTION OF THE DRAWINGS

The above and other features and advantages of the present invention will become more apparent by describing in detail exemplary embodiments thereof with reference to the attached drawings in which.

Throughout the drawings, like reference numerals will be understood to refer to like parts, components and structures.

DETAILED DESCRIPTION OF EXEMPLARY EMBODIMENTS

Exemplary embodiments of the present invention will now be described in greater detail with reference to the accompanying drawings.

Figure 1:
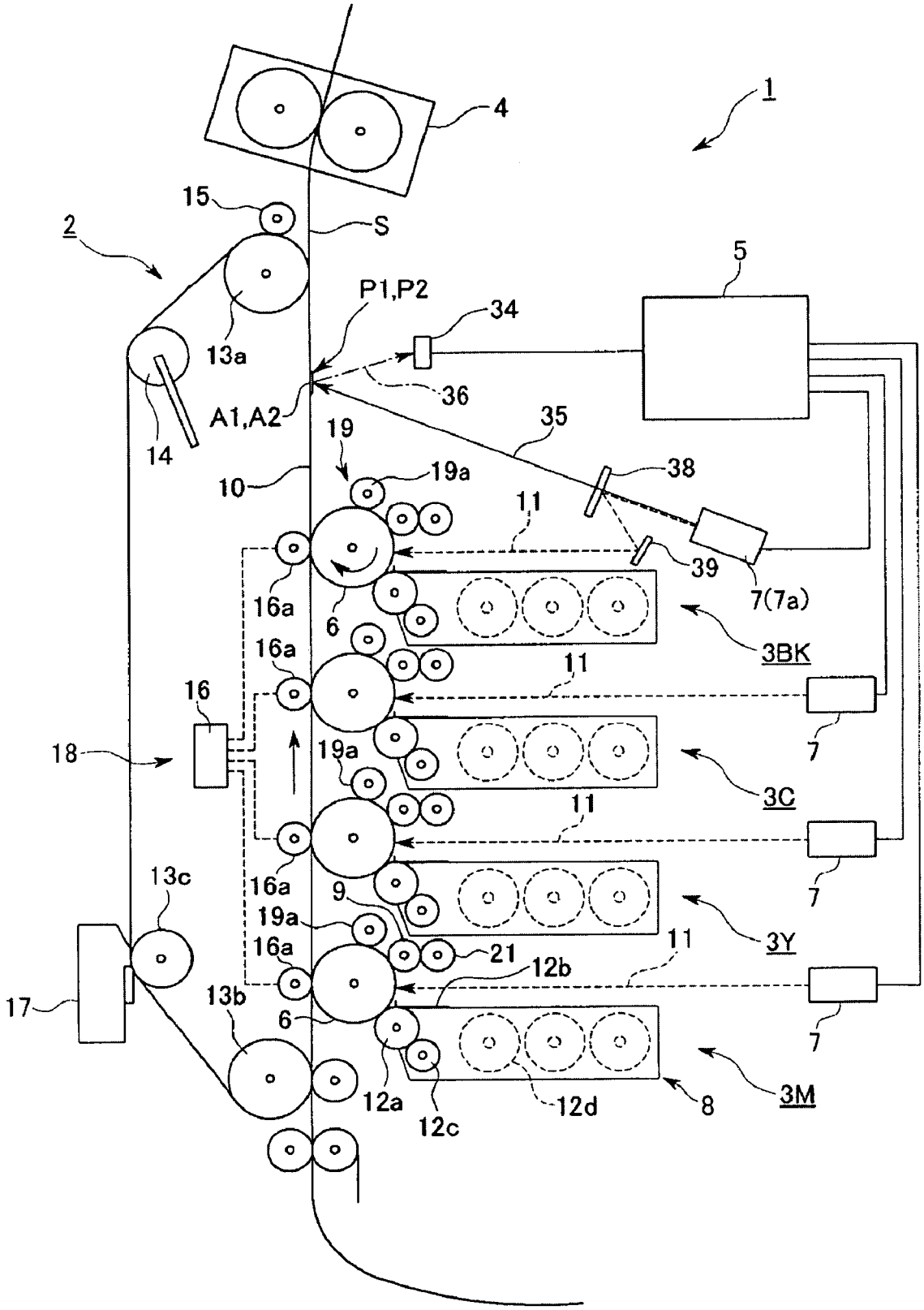
FIG. 1 is a schematic view of an image forming apparatus according to an embodiment of the present invention.

FIG. 1 is a schematic view of an image forming apparatus according to an embodiment of the present invention. Referring to FIG. 1, an image forming apparatus 1 includes a delivering unit 2, a plurality of image forming units 3M, 3Y, 3C and 3BK installed on the delivering unit 2, a fixing unit 4, and a control unit 5 for controlling the image forming units 3M, 3Y, 3C and 3BK.

Regarding the image forming units 3M, 3Y, 3C and 3BK, the single image forming unit 3M will be described as an example of each. The other image forming units 3Y, 3C and 3BK have a substantially identical structure as the image forming unit 3M.

Figure 3:
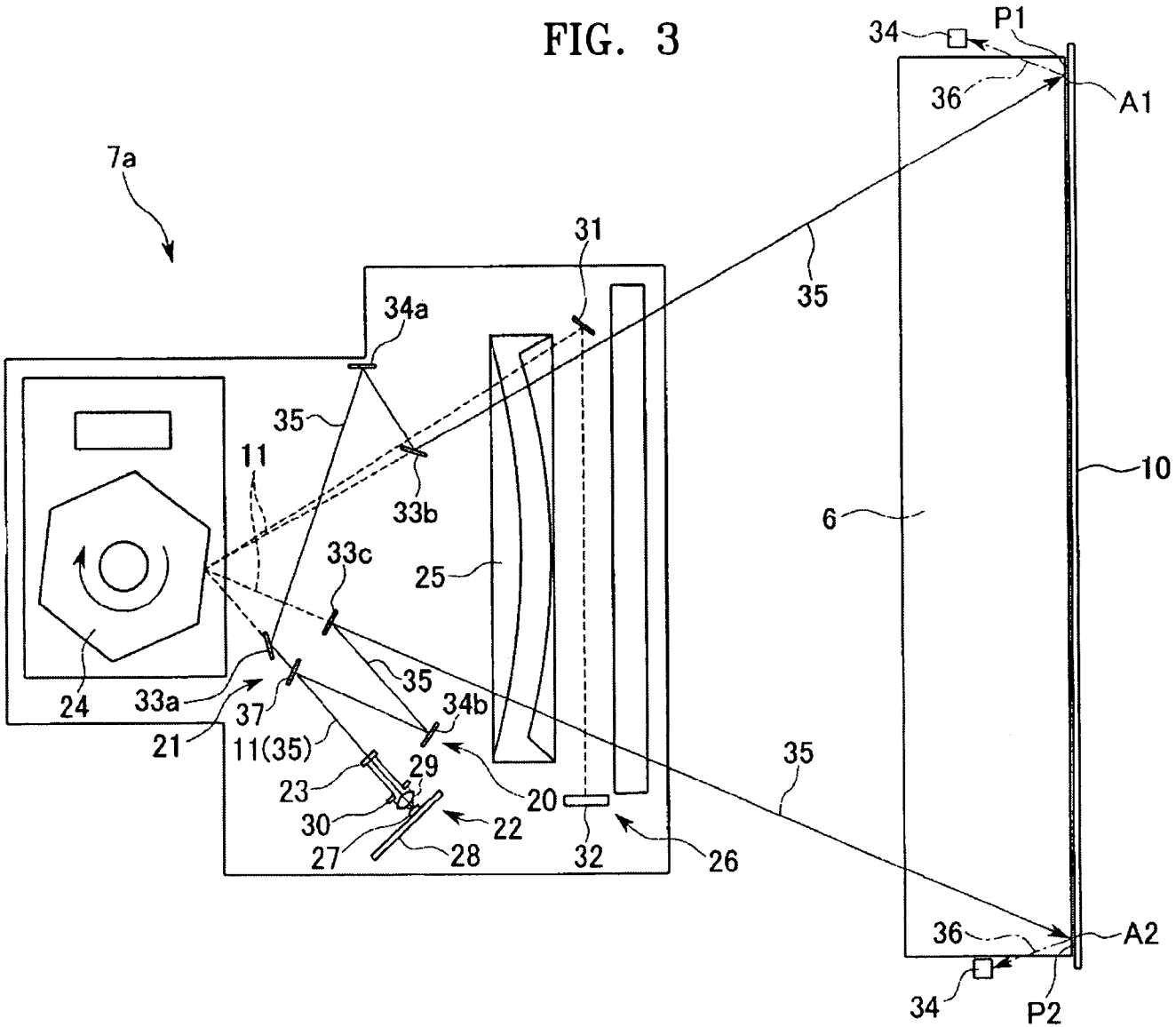
FIG. 3 is a schematic view illustrating an image forming apparatus according to an embodiment of the present invention.

In the image forming units 3M, 3Y, 3C and 3BK of FIGS. 1 and 3, a laser beam 11 emitted from a light source 22 is deflected by a polygon mirror 24 and scanned on a surface of a charged photosensitive drum 6 such that a latent image is formed. An image obtained by developing the latent image is then transferred onto a recording medium S delivered by a transfer belt 10. The image forming units 3M, 3Y, 3C and 3BK are arranged along the transfer belt 10 in a transferring direction. Images, specifically magenta, yellow, cyan and black toner images are formed toward the uppermost side with respect to the transferring direction of the transfer belt 10. Each of the image forming units 3M, 3Y, 3C and 3BK includes a photosensitive drum 6, an exposing unit 7, a developing unit 8, a charge roller 9, and a cleaning unit 19.

The photosensitive drum 6 axially rotates in a direction indicated by an arrow of FIG. 1 and forms the latent image on a drum surface as the exposing unit 7 scans the laser beam 11.

The exposing unit 7 scans the laser beam 11 onto an exposing position on the photosensitive drum 6 in a constant direction parallel to a rotation axis of the photosensitive drum 6.

The developing unit 8 develops the latent image to form a developed image. The developing unit 8 frictionally charges a powdered toner having a predetermined color to make the toner negatively charged. The developing unit 8 also attaches the toner to the surface of the photosensitive drum 6 by supplying the toner to an exposed region of the photosensitive drum 6, which has a relative positive potential compared with an unexposed region. The developing unit 8 includes an agitator 12*d* for agitating and charging the toner, a supply roller 12*c* for delivering the charged toner toward a developing roller 12*a*, a developing roller 12*a* for delivering the toner toward the photosensitive drum 6 and attaching the toner to a surface of the photosensitive drum 6 by a Coulomb's force, and a developing blade 12*b* disposed on the developing roller 12*a* for regulating a layer thickness of the toner.

A developing method using the developing unit 8 can include a 1-component developing method or a 2-component developing method. The 2-component developing method uses a carrier as well as a toner. However, it is preferable to use the 1-component developing method because it is simple and reduces costs.

In the embodiment of FIG. 1, the developing roller 12*a* does not necessarily contact the photosensitive drum 6. Where it is possible to attach the toner to the photosensitive drum 6 without contact, the developing roller 12*a* may be spaced apart from the photosensitive drum 6 by a predetermined gap.

The toner used in the developing unit 8 may be formed by a grinding method or a polymerizing method.

The cleaning unit 19 includes a photosensitive drum cleaning roller 19*a* and a case (not shown). The photosensitive drum cleaning roller 19*a* contacts the photosensitive drum 6 and removes the remaining toner from the surface of the photosensitive drum 6. The case is disposed adjacent to the cleaning roller 19*a* and collects the toner removed by the cleaning roller 19*a*. Also, if necessary, a controller (not shown) can be used to apply a cleaning bias voltage to the cleaning roller 19*a*.

The charge roller 9 provides the photosensitive drum 6 with a predetermined surface potential for image forming. In the charge roller 9, a roller part is comprised of an elastic material and a conductive metal shaft. The charge roller 9 contacts the photosensitive drum 6 at a charge position located next to the cleaning roller 19. The charge roller 9 is pressed on the photosensitive drum 6 at a predetermined pressure by pressing a bearing (not shown) using an elastic pressing unit, such as a spring. As a result, the roller part is deformed and a nip portion is formed such that the roller part contacts a predetermined width in a circumferential direction with respect to the photosensitive drum 6. When a DC voltage is applied to the charge roller 9, the surface of the photosensitive drum 6 can be charged with a predetermined voltage. The charge roller cleaning roller 21 also directly contacts the charge roller 9 and cleans the surface of the charge roller 9.

Next, the delivering unit 2 will now be described. In the delivering unit 2, driven rollers 13*a*, 13*b* and 13*c*, and a tension roller 14 are disposed about an inner periphery of a transfer belt 10. The transfer belt 10 is circulated in one direction by the driven rollers and the tension roller. A drive roller 15 is disposed at an outer periphery of the transfer belt 10. The drive roller 15 is pressed on the driven roller 13*a*, with the transfer belt 10 interposed therebetween. The transfer roller 16*a* is supported against the transfer belt 10 such that the transfer belt 10 is in contact with the photosensitive drum 6 at the transfer position. A belt cleaning unit 17 contacts a cleaning blade with the transfer belt 10 and scrapes any remaining material attached to the surface of the transfer belt 10. The belt cleaning unit 17 also has a space for collecting the scraped material.

The drive roller 15 is pressed toward the driven roller 13*a* by an elastic pressing unit, such as a spring. When the drive roller 15 is rotated by a drive unit (not shown), the transfer belt 10 disposed between the drive roller 15 and the driven roller 13*a* is circulated in a direction indicated by an arrow.

The transfer belt 10 is made of a dielectric sheet so that it can absorb the toner from the photosensitive drum 6 by using a transfer voltage applied to the transfer roller 16*a* contacting a rear surface when a recording medium S is inserted. The transfer belt 10 also has a surface characteristic that reflects light as described in greater detail below.

The transfer roller 16*a* has a roller part that is made of a conductive or semiconductive synthetic rubber. A rotation axis of the transfer roller 16*a* contacts a high voltage source (not shown) for the transferring and control of a surface potential of the roller part.

The control unit 16 controls the transfer roller 16*a* and the surface potential of the roller part, and a transfer unit 18 may be further provided to transfer, in an electrostatic manner, the image formed by the image forming units 3M, 3Y, 3C and 3BK onto the recording medium S delivered by the transfer belt 10.

Figure 2:
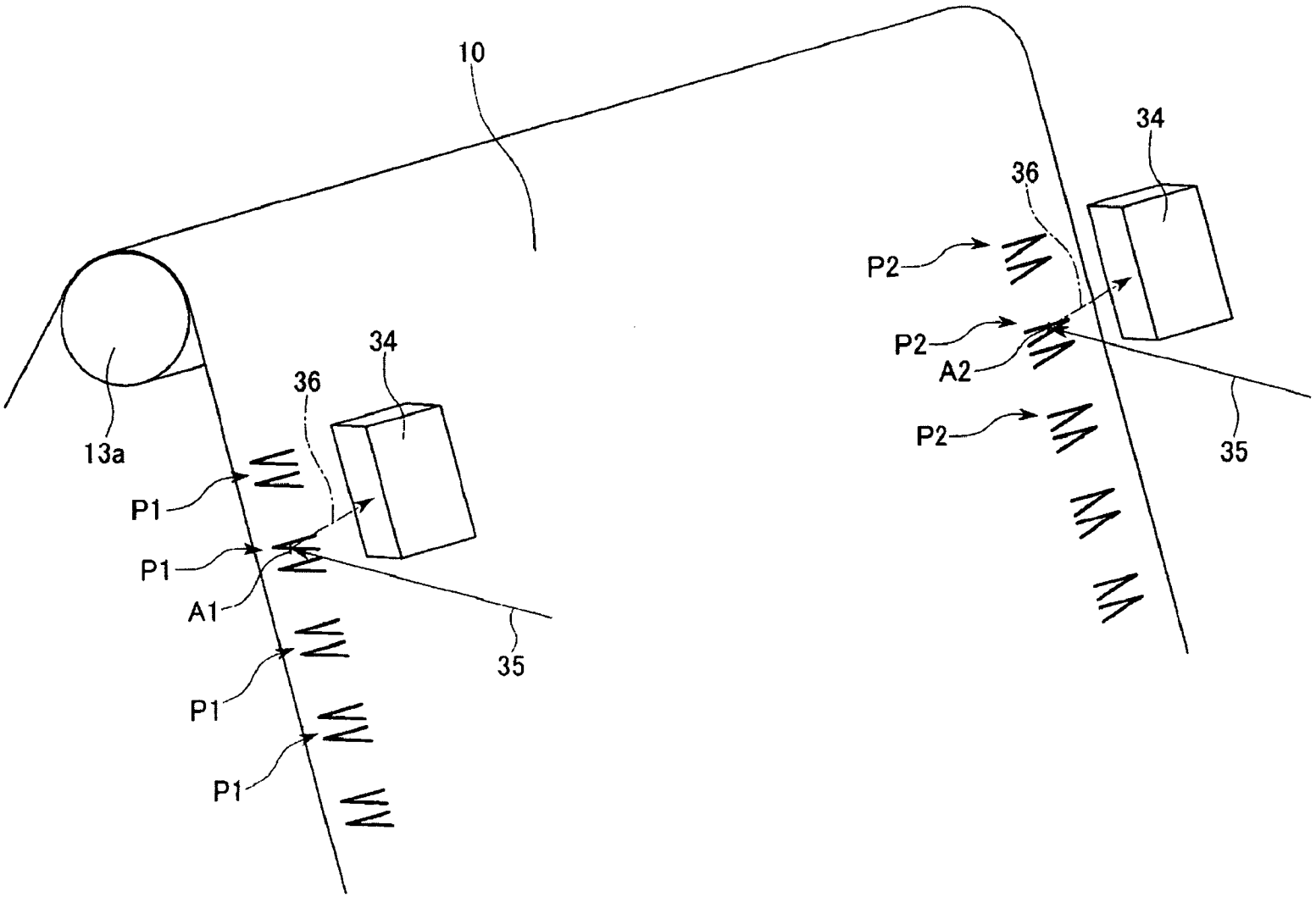
FIG. 2 is a partial perspective view of an image forming apparatus according to an embodiment of the present invention.

FIG. 2 is a partial perspective view of the delivering unit 2 disposed next to the last image forming unit 3BK. Referring to FIGS. 1 and 2, several zigzag-shaped toner patches (that is, sensed images) P1 and P2 are formed on the surface edges of the transfer belt 10 by the image forming units 3M, 3Y, 3C and 3BK. The toner patches P1 and P2 are formed on both edges of the surface of the transfer belt 10. The image forming units 3M, 3Y, 3C and 3BK overlap the respective color images to form the toner patches P1 and P2. When the transfer belt 10 is circulated, the toner patches P1 and P2 are moved in one direction. Points which the toner patches P1 and P2 pass through are then set as the sensing positions A1 and A2.

Unlike the laser exposing units 7 installed in the image forming units 3M, 3Y and 3C, the laser exposing unit 7 installed in the last image forming unit 3BK is a combined light source and exposing unit 7*a*, which also serves as a light source which guides the sensing laser beam 35 for the toner patches P1 and P2.

FIG. 3 is a schematic view illustrating a structure of the combined light source and exposing unit 7*a*. Referring to FIG. 3, the combined light source and exposing unit 7*a* includes a light source 22, a cylinder lens (that is, an imaging member) 23, a polygon mirror (that is, a deflection unit) 24, a Fθ lens (that is, an imaging element) 25, and a synchronous sensing unit 26.

The light source 22 includes a semiconductor laser 27, a base for fixing the semiconductor laser 27, a driver circuit for driving the semiconductor laser 27, a collimating lens 29 disposed in front of a light emitting part of the semiconductor laser 27, and a slit member (that is, a light regulating member) 30 disposed in front of the collimating lens 29. The collimating lens 29 is a lens or lens group which converts the laser beam 11 emitted from the semiconductor laser 27 into a parallel beam. The slit member 30 then forms the parallel beam into a predetermined shape.

The cylinder lens 23 has a refractive power in only a sub-scanning direction. The cylinder lens 23 images the laser beam 11 of the parallel beam cut by the slit member 30 in a sub-scanning direction and produces the linear beam in a main-scanning direction.

The polygon mirror 24 deflects the imaged laser beam 11 near an imaging position in the main-scanning direction. In this embodiment, the polygon mirror 24 is a hexagonal rotating polygon mirror within a plane perpendicular to the sub-scanning direction and a motor (not shown) which rotates the polygon mirror 24 at a constant angular velocity in a direction indicated by an arrow of FIG. 3.

The Fθ lens 25 is a lens or lens group for imaging the laser beam 11 deflected by the polygon mirror 24 such that the laser beam 11 can have an appropriate diameter at a scanning line position on the surface of the photosensitive drum 6, and it has a Fθ characteristic that allows the scanning velocity of the main-scanning direction to be uniform.

The synchronous sensing unit 26 includes a foldable mirror 31 and a synchronous sensor unit 32. The foldable mirror 31 turns the beam of the scanning start side of a non-image region among the laser beam 11, which is emitted from the Fθ lens 25, in a direction intersecting with an optical axis, and thereby guides the beam toward the synchronous sensor unit 32. The synchronous sensor unit 32 controls the image reading by sensing the arrival of the beam turned by the foldable mirror 31.

Referring to FIGS. 1 and 3, the image forming apparatus 1 includes an optical path changing unit 20 and an optical path branching unit 21. The optical path changing unit 20 is disposed inside the combined light source and exposing unit 7*a* and changes the optical path of the laser beam 11 emitted from the light source 22 to create the sensing laser beam 35 of the laser beam 11. The optical path branching unit 21 is also disposed inside the combined light source and exposing unit 7*a* and branches the laser beam 11 (that is, the sensing laser beam 35) into two or more paths.

The optical path branching unit 21 includes a movable half mirror 37 and a motion unit (not shown) for moving the movable half mirror 37. The laser beam 11 (the sensing laser beam 35) emitted from the cylinder lens 23 is divided into a transmitted sensing laser beam 35 and a reflected and folded sensing laser beam 35. Also, the half mirror 37 is disposed in front of the cylinder mirror 23, and the laser beam 11 (the sensing laser beam 35) from the light source 22 is branched before reaching the polygon mirror 24. Due to the motion unit (not shown), the half mirror 37 disposed on the optical path of the laser beam 11 is movable from the reflection position of the laser beam to a position which is clear of the laser beam 11.

The optical path changing unit 20 includes first to third moving mirrors 33*a*, 33*b* and 33*c*, first and second fixed mirrors 34*a* and 34*b*, and a motion unit (not shown) for moving the moving mirrors. The optical path changing unit 20 guides the laser beam 11 (the sensing laser beam 35) toward the sensing positions A1 and A2 located on the transfer belt 10.

The first moving mirror 33*a* is disposed between the half mirror 37 and the polygon mirror 24, and reflects the transmitted sensing laser beam 35 divided by the half mirror 37. Also, due to the motion unit (not shown), the first moving mirror 33*a* is movable from the position where the laser beam 11 (the sensing laser beam 35) emitted from the cylinder lens 23 is reflected, to a position which is clear of the laser beam 11.

The first fixed mirror 34*a* is disposed at the position at which the reflected sensing laser beam 35 is reflected, and the second fixed mirror 34*b* is disposed at the position at which the folded sensing laser beam 35 divided by the half mirror 37 is reflected. Also, the second moving mirror 33*b* is disposed at the position at which the sensing laser beam 35 is reflected by the first fixed mirror 34*a*, and the sensing laser beam 35 reflected by the second moving mirror 33*b* passes through the Fθ lens 25 and is guided to the sensing position A1 of one toner patch P1. The third moving mirror 33*c* is disposed at the position at which the sensing laser beam 35 is reflected by the second fixed mirror 34*b*, and the sensing laser beam 35 reflected by the third moving mirror 33*c* passes through the Fθ lens 25 and is guided to the sensing position A2 of the other toner patch P2.

The sensors 34 facing the toner patches P1 and P2 are disposed outside the ring-shaped transfer belt 10. The sensors 34 receive the reflected light 36 of the sensing laser beam 35 from the sensing positions A1 and A2, and senses the position difference (that is, color difference) of each color image constituting the toner patches P1 and P2. The sensing signals sensed by the sensors 34 are then transmitted to the control unit 5, and the control unit 5 controls the image forming units 3M, 3Y, 3C and 3BK according to the sensed signals.

Referring to FIG. 1, the last image forming unit 3BK includes a fourth moving mirror 38, a third fixed mirror 39, and a motion unit (not shown) for moving the fourth moving mirror 38. The fourth moving mirror 38 is disposed at a position at which the laser beam 11 emitted from the combined light source and exposing unit 7*a* is directed. Due to the motion unit (not shown), the fourth moving mirror 38 is movable from the position at which the laser beam 11 is directed, to a position which is clear of the sensing laser beam 35 for illuminating the sensing positions A1 and A2. The third fixed mirror 39 is disposed at a position at which the laser beam 11 is reflected by the fourth moving mirror 38, and the laser beam 11 reflected by the third fixed mirror 39 is scanned on the surface of the photosensitive drum 6.

Referring to FIGS. 1 to 3, the first to third moving mirrors 33*a*, 33*b* and 33*c* and the first and second fixed mirrors 34*a* and 34*b* are installed such that the length of the optical path from the light source 22 to the Fθ lens 25 of the sensing laser beam 35 illuminating the sensing positions A1 and A2, is as long as the length of the optical path from the light source 22 to the Fθ lens 25 of the laser beam 11 scanned to the surface of the photosensitive drum 6. Also, the fourth moving mirror 38 and the third fixed mirror 39 are installed such that the length of the optical path from the Fθ lens 25 to the sensing positions A1 and A2 of the sensing laser beam 35 illuminating the sensing positions A1 and A2, is as long as the length of the optical path from the Fθ lens 25 to the surface of the photosensitive drum 6 of the laser beam 11 scanned to the surface of the photosensitive drum 6.

The fixing unit 4 includes a roller pair for thermally fixing the toner to the recording medium S delivered by the delivering unit 2.

An operation of the image forming apparatus 1 will now be described in greater detail.

Since an overall operation of the image forming apparatus 1 is in most respects substantially the same as that of a known color printer, a detailed description thereof will be omitted. The following detailed description will be made in regard to the last image forming unit 3BK.

First, the laser beam 11 (the sensing laser beam 35) is emitted from the light source 22 of the combined light source and exposing unit 7*a* and is directed by the optical path changing unit 20 and the optical path branching unit 21 to illuminate the sensing positions A1 and A2, and the color difference of the toner patches P1 and P2 are sensed.

Specifically, the motion unit (not shown) moves the half mirror 37 on the optical path of the laser beam 11. The motion unit (not shown) also moves the first to third moving mirrors 33*a*, 33*b* and 33*c* to the positions at which the sensing laser beam 35 is reflected. Also, the motion unit (not shown) further moves the fourth moving mirror 38 to a position which is clear of the sensing laser beam 35. The sensing laser beams 35 emitted from the light source 22 are then reflected by the half mirror 37, the first to fourth moving mirrors 33*a*, 33*b*, 33*c* and 38, and the first to third fixed mirrors 34*a*, 34*b* and 39, such that the laser beams 35 illuminate the sensing positions A1 and A2. At this point, the sensing laser beams 35 are imaged in the sub-scanning and main-scanning directions by the cylinder lens 23 and the Fθ lens 25, respectively. If the sensing laser beams 35 illuminate the sensing positions A1 and A2, the reflected beams 36 reach the sensors 34. The sensors 34 then sense the position difference of each color at the sensing positions A1 and A2 of the toner patches P1 and P2.

Based on the data sensed by the sensors 34, the image forming units 3M, 3Y, 3C and 3BK are then adjusted and the color difference is corrected.

Specifically, the signals sensed by the sensors 34 are transmitted to the control unit 5. Based on the sensed signals, the main-scanning and sub-scanning read timing and main-scanning magnification and skew, which are transmitted to the image forming units 3M, 3Y, 3C and 3BK, are controlled. Also, the color difference of each image formed by the image forming units 3M, 3Y, 3C and 3BK is corrected.

The image forming units 3M, 3Y, 3C and 3BK then form the images on the recording medium S delivered by the transfer belt 10. Specifically, the laser beam 11 emitted from the light source 22 is deflected by the polygon mirror 24. A latent image is formed by scanning the laser beam 11 on the surface of the photosensitive drum 6 charged by the charge roller 9. The developing unit 8 develops the latent image to form a developed image. The developed image formed on the surface of the photosensitive drum 6 is transferred onto the recording medium S delivered by the transfer belt 10. At this point, the motion unit (not shown) moves the half mirror 37 out of the optical path of the laser beam 11, and also moves the first to third moving mirrors 33*a*, 33*b* and 33*c* out of the optical path of the laser beam 11. The motion unit (not shown) further moves the fourth moving mirror 38 such that the fourth moving mirror 38 is disposed at the position at which the laser beam 11 is directed.

The image forming apparatus includes the optical path changing unit 20 which changes the optical path of the laser beam 11 emitted from the light source 22 before the laser beam 11 reaches the polygon mirror 24, and guides the laser beam 11 (the sensing laser beam 35) to the sensing positions A1 and A2 of the toner patches P1 and P2 formed on the surface of the transfer belt 10. Therefore, a dedicated light source or driver circuit is not required to sense the position difference. The sensing laser beam 35 illuminates the sensing positions A1 and A2 using the light source 22 of the image forming unit 3BK. Thus, the cost of the light source is reduced, so the overall apparatus cost is reduced.

Also, since the optical path of the laser beam 11 emitted from the light source 22 has been changed before the laser beam 11 reaches the polygon mirror 24, the sensing laser beam 35 illuminating the sensing positions A1 and A2 is not scanned. While the optical path is changed by the optical path changing unit 20, the sensing laser beam 35 illuminates the sensing positions A1 and A2. In this manner, it is possible to correctly sense the color difference of the toner patches P1 and P2 at the sensing positions A1 and A2, thereby increasing the sensing precision.

Also, the optical path branching unit 21 branches the optical path of the laser beam 11 emitted from the light source 22 into two paths, and the toner patches P1 and P2 are formed on both edges of the surface of the transfer belt 10. The laser beams 11 (the sensing laser beams 35) branched by the optical path branching unit 21 are propagated to the sensing positions A1 and A2 of the toner patches P1 and P2 by the optical path changing unit 20. Therefore, the position difference of the toner patches P1 and P2 which may be easily mismatched, are sensed at the sensing positions A1 and A2, respectively. Therefore, the color difference can be correctly sensed. Also, since the sensing laser beam 35 from one light source 22 illuminates the two sensing positions A1 and A2, the number of sensing positions A1 and A2 can be increased without increasing the number of the light source 22. Thus, the color difference can be correctly obtained at a lower cost.

The image forming unit 3BK includes the Fθ lens 25 for imaging the laser beam 11 deflected by the polygon mirror 24 on the photosensitive drum 6 (on the scanning line). The sensing laser beam 35 whose optical path is changed by the optical path changing unit 20 is imaged on the sensing positions A1 and A2 by the same Fθ lens 25. Therefore, it is unnecessary to install a dedicated optical lens to sense the position difference. Also, due to the Fθ lens 25 of the image forming unit 3BK, the sensing laser beam 35 illuminating the sensing positions A1 and A2 becomes narrow. As a result, the cost of the optical lens is reduced and thus, the overall cost is reduced.

Figure 4:
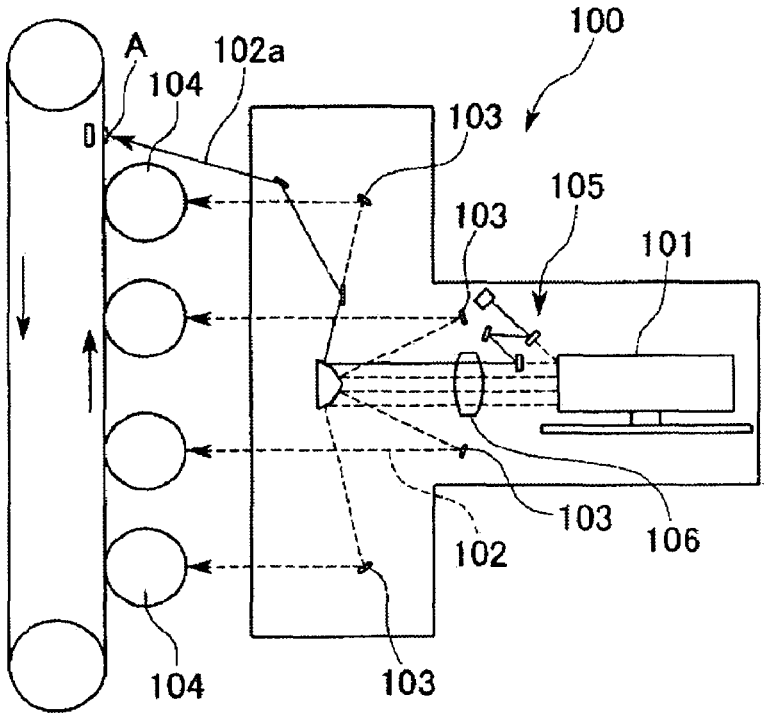
FIG. 4 is a schematic view of an image forming apparatus according to another embodiment of the present invention.

While the present invention has been particularly shown and described with reference to exemplary embodiments thereof, it will be understood by those of ordinary skill in the art that various changes in form and details may be made therein without departing from the spirit and scope of the present invention as defined by the following claims. For example, while the image forming apparatus includes four image forming units and the four image forming units include the exposing units, the present invention can also be constructed as shown in FIG. 4 in accordance with another embodiment of the present invention. That is, a plurality of lights 102 can be deflected by the deflecting unit 101 of one exposing unit 100, and the deflected lights 102 can be guided to the surface of each photosensitive drum 104 by a plurality of mirrors 103. In this embodiment, an optical path of at least one of a plurality of lights is changed by an optical path changing unit 105 and a sensing light 102*a* is guided to a sensing position A. Also, a reference numeral 106 in FIG. 4 represents a Fθ lens (that is, an imaging device).

Figure 5:
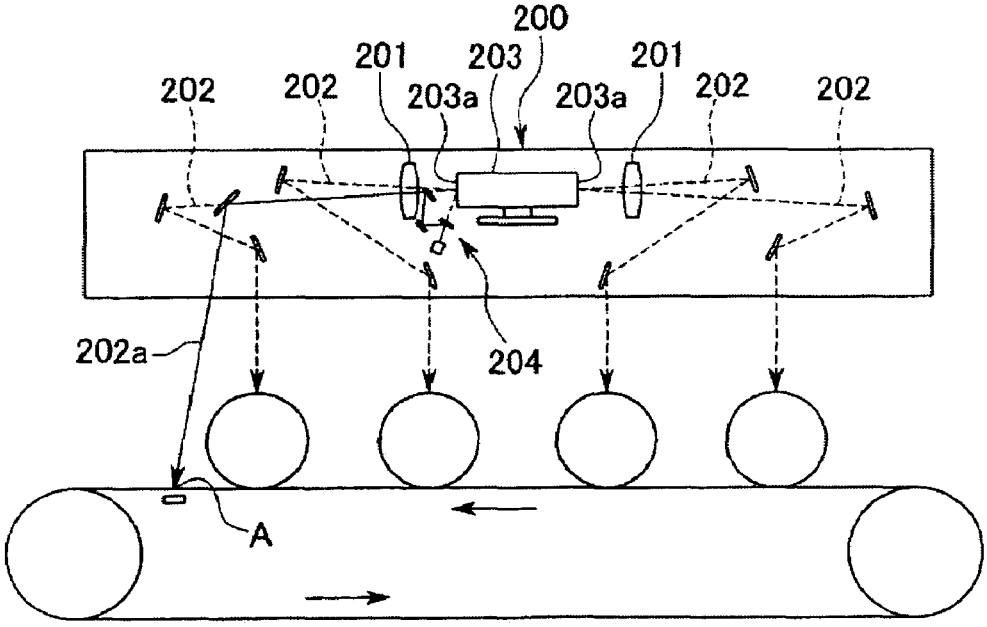
FIG. 5 is a schematic view of an image forming apparatus according to another embodiment of the present invention.

Returning to FIG. 3, while only one Fθ lens 25 is installed in the exposing unit 7*a* and the polygon mirror 24 deflects the laser beam 11 at one surface, the present invention can also be constructed as shown in FIG. 5 in accordance with another embodiment of the present invention. That is, a plurality of Fθ lenses can be installed inside the exposing unit 200 and reflect a plurality of lights 202 at a plurality of surfaces 203*a* of the polygon mirror 203. Likewise, an optical path of at least one of a plurality of lights is changed by an optical path changing unit 204 and a sensing light 202*a* is guided to a sensing position A.

In the above-described image forming apparatus 1, the transfer belt 10 also has a light reflection characteristic, and the color difference is sensed by the sensor 34 receiving the reflected light 36. The present invention can also include a sensor for receiving a transmitted light using a transfer material having a light transmission characteristic.

While the four image forming units 3M, 3Y, 3C and 3BK are vertically arranged in the embodiment of FIG. 1, in yet another embodiment of the present invention, a plurality of image forming units can also be horizontally arranged. Also, while the image forming apparatus 1 includes four one-color image forming units 3M, 3Y, 3C and 3BK, the present invention is not limited thereto. That is, in yet another embodiment of the present invention the image forming apparatus can include two-color image forming units, and the number of the image forming units can be changed.

Further, while the image forming apparatus 1 delivers the recording medium S using the transfer belt 10, transfers the image formed on the photosensitive drum 6 onto the recording medium S, and forms an image on the recording medium S, other embodiments of the present invention can also use an intermediate transfer belt as the transfer belt, transfer an image formed on a photosensitive drum onto the transfer belt, and then form an image formed on the transfer belt onto a recording medium.

According to the present invention, the image forming apparatus includes the optical path changing unit which changes the optical path of the laser beam emitted from the light source before the laser beam reaches the deflecting unit, and guides the laser beam to the sensing positions of the toner patches formed on the surface of the transfer belt. Therefore, a dedicated light source or driver circuit is not required to sense the position difference. Also, the sensing laser beam illuminates the sensing positions using the light source of the image forming unit. Thus, the cost of the apparatus is reduced. Further, while the optical path is changed by the optical path changing unit, the sensing laser beam is used to illuminate the sensing positions. Thus, it is possible to correctly sense the color difference of the toner patches at the sensing positions, thereby increasing the sensing precision.

What is claimed is:

1. An image forming apparatus comprising:

a transfer belt;

an image forming unit comprising a deflecting unit for deflecting a light emitted from a light source, wherein the image forming unit is configured to form a latent image on a surface of a charged photosensitive unit by scanning the deflected light, develop the latent image, and transfer the developed image onto the transfer belt or a recording medium delivered by the transfer belt;

an optical path changing unit for changing an optical path of the light emitted from the light source before the light reaches the deflecting unit, and for guiding the light to a sensing position of a sensing image formed on a surface of the transfer belt;

a sensing unit for receiving a light reflected by the sensing position thereby sensing the sensing image and in response, providing a sensing signal; and a control unit for controlling the image forming unit according to the sensing signal of the sensing unit.

2. The image forming apparatus of claim 1, further comprising:

an optical path branching unit for branching the optical path of the light emitted from the light source into several paths; and a plurality of sensing images formed on a surface of the transfer belt, wherein the optical path changing unit guides the branched light to a sensing position of each of the plurality of sensing images.

3. The image forming apparatus of claim 1, wherein the image forming unit further comprises:

an imaging element for imagining the deflected light onto a scanning line, and for imaging the light whose optical path is changed onto the sensing positions.

4. The image forming apparatus of claim 2, wherein the image forming unit further comprises:

an imaging element for imaging the deflected light onto a scanning line, and for imaging the light whose optical path is branched onto the sensing positions.

5. The image forming apparatus of claim 1, wherein the sensing image comprises a plurality of zigzag-shaped toner patches.

6. The image forming apparatus of claim 5, wherein the toner patches are formed on surface edges of the transfer belt.

7. The image forming apparatus of claim 5, wherein the toner patches are formed by the image forming unit.

8. A method for controlling an image forming apparatus, comprising the steps of:

deflecting a light emitted from a light source to form a latent image on a surface of a charged photosensitive unit, developing the latent image, and transferring the developed image onto a transfer belt or a recording medium delivered by a transfer belt;

changing an optical path of the light emitted from the light source before the light reaches a deflecting unit, and guiding the light to a sensing position of a sensing image formed on a surface of the transfer belt;

receiving a light reflected by the sensing position thereby sensing the sensing image and in response, providing a sensing signal; and controlling the image forming apparatus according to the sensing signal.

9. The method of claim 8, further comprising the steps of:

branching the optical path of the light emitted from the light source into several paths; and forming a plurality of sensing images on a surface of the transfer belt, wherein the step of branching the optical path further guides the branched light to a sensing position of each of the plurality of sensing images.

10. The method of claim 9, further comprising the steps of:

imaging the deflected light onto a scanning line; and imaging the light whose optical path is changed onto the sensing positions.

11. The method of claim 9, further comprising the steps of:

imaging the deflected light onto a scanning line; and imaging the light whose optical path is branched onto the sensing positions.

12. The method of claim 9, wherein the step of forming the plurality of sensing images comprises:

forming a plurality of zigzag-shaped toner patches on surface edges of the transfer belt.

13. The method of claim 12, further comprising the steps of:

moving the toner patches in one direction and setting points which the toner patches pass through as the sensing positions.

* * * * *